United States Patent [19]

Schuller et al.

[11] Patent Number: 4,501,116

[45] Date of Patent: Feb. 26, 1985

[54] PROCESS FOR WINDING A NEWLY JOINED THREAD ONTO A TUBE NEWLY INSERTED IN A SPOOLING DEVICE

[75] Inventors: Edmund Schuller; Walter Mayer, both of Ingolstadt; Eugen Hini, Lenting; Erich Bock, Wettstetten; Kurt Lovas, Bohmfeld, all of Fed. Rep. of Germany

[73] Assignee: Schubert & Salzer, Ingolstadt, Fed. Rep. of Germany

[21] Appl. No.: 396,278

[22] Filed: Jul. 8, 1982

[30] Foreign Application Priority Data

Jun. 13, 1981 [DE] Fed. Rep. of Germany ..... 3123494

[51] Int. Cl.[3] ..... D01H 15/00

[52] U.S. Cl. ..... 57/263

[58] Field of Search ..... 57/261, 263, 299, 301, 57/303-306, 22

[56] References Cited

U.S. PATENT DOCUMENTS

| | | | |
|---|---|---|---|
| 3,842,579 | 10/1974 | Bartling | 57/263 |
| 3,858,385 | 1/1975 | Shinkai et al. | 57/263 |
| 3,911,658 | 10/1975 | Smith | 57/263 |
| 4,006,864 | 2/1977 | Tooka | 57/263 X |
| 4,083,171 | 4/1978 | Konig et al. | 57/263 |
| 4,139,162 | 2/1979 | Stahlecker | 57/263 X |
| 4,223,517 | 9/1980 | Husges et al. | 57/263 X |

*Primary Examiner*—Donald Watkins

*Attorney, Agent, or Firm*—Dority & Manning

[57] ABSTRACT

In order to wind a newly joined thread onto a tube newly inserted on a spooling device on an open-end spinning mechanism, the newly joined thread, together with a thread portion containing a leader, is guided away before the start of the bobbin build-up. Thereupon, the thread portion containing the leader is severed from the thread, and subsequently, the thread supplied by the open-end spinning mechanism is transferred to the newly inserted tube. To exchange a full bobbin for a new tube, a thread break is produced, the open-end spinning mechanism is cleaned and the thread is thereupon joined anew. To carry out this process, there are, on an open-end spinning mechanism, provided with a thread-joining device and a spooling device, a thread-suction device (4), a thread feeder (42) transferring the thread (35) supplied to the thread-suction device (4) to a newly inserted tube, and a thread-severing device (41) assigned to the thread-suction device (4).

6 Claims, 6 Drawing Figures

PROCESS FOR WINDING A NEWLY JOINED THREAD ONTO A TUBE NEWLY INSERTED IN A SPOOLING DEVICE

BACKGROUND OF THE INVENTION

The present invention relates to a process for winding a newly joined thread onto a tube newly inserted on a spooling device on an open-end spinning mechanism, and to an apparatus for carrying out this process.

It is known, after the machine has stopped, to join the thread anew by means of a thread resupplied from a starter bobbin and subsequently to wind the thread portion containing the leader onto this starter bobbin, whereupon, without an interruption in the spinning operation, the starter bobbin is exchanged for an empty tube to which the thread is then transferred. In this case, the start of winding onto the newly inserted empty tube does not involve any new thread-joining, so that the start of the bobbin has no leader although a starter bobbin is necessary for thread-joining.

It is also known, in connection with a bobbin change, to interrupt the spinning operation at the particular spinning unit to clean the spinning element and to join the thread anew (Sussen-WST-Technische Mitteilungen: "Automation of the rotor-spinning machine with CleanCat/CLC and SpinCat/SPC—Aspects and Perspective—", page 23, paragraph 3.12: "Elimination of thread breaks which arise during the bobbin change—'-'interrupted bobbin change"—"). In this case, however, the leader obtained passes onto the bobbin. This leader represents, as a rule, a thick or thin place and therefore an irregularity in the yarn and is consequently undesirable.

To prevent leaders from passing onto the bobbin, it is also known to replace the leader by a knot (German Offenlegungschrift No. 2,242,151, claim 3). Although knots have the advantage that they do not reduce the yarn strength, nevertheless, they also form an irregularity in the yarn. It is, therefore, desirable for further processing that the yarn should contain as few knots as possible. Besides, during further processing of the yarn, the thread end of a running-off bobbin has to be connected to the thread start of a new bobbin so that bobbin connecting knots of this type are unavoidable. However, in addition to these connecting knots there are also, directly adjacent to them, the knots which replace the attachment points. In order to do away with knots of this type which replace the attachment points, the bobbin coming from the open-end spinning unit has to be wound round in an additional operation, this knot, which replaces the leader, then being severed.

SUMMARY OF THE INVENTION

The object of the present invention is, therefore, to provide a process and an apparatus which make it possible, despite rejoining of the thread, to prevent, without the aid of a starter bobbin to be exchanged, either a leader or a thread connection replacing the leader from passing onto the start of the newly inserted tube.

This object is achieved, according to the invention, by the fact that the newly joined thread, together with the leader, is guided away before the start of the bobbin build-up, whereupon the thread portion containing the leader is severed from the thread, and subsequently the thread supplied from the open-end spinning mechanism is transferred to the newly inserted tube. The winding according to the invention of a newly joined thread onto a tube newly inserted in the spooling device can be carried out after a relatively long stoppage of the machine such as occurs with a replacement of the spinning mechanism, for example, a spinning rotor, a batch change, a bobbin change, and the like. In this case, the leader in the newly joined thread is guided away before the bobbin build-up has started, and the thread portion containing the leader is thereupon severed from the remaining thread. The thread leader is eliminated in this way. The thread supplied by the open-end spinning mechanism therefore no longer contains any irregularity and is of perfect quality. It is then transferred to the tube newly inserted beforehand.

Since, as a result of the process according to the invention, the winding of the leader arising in connection with the bobbin change onto the newly inserted tube is avoided, the spinning process can be interrupted during the bobbin change without adverse consequences. According to the invention, therefore, to exchange the full bobbin for a new tube a thread break is produced, the open-end spinning mechanism is cleaned and the thread is thereupon joined anew. This ensures that each new bobbin can be made under the same spinning conditions which, of course, depend essentially on the state of the collecting surface of the open-end spinning mechanism.

Advantageously, especially under difficult thread-joining conditions, thread-joining takes place after the bobbin change by means of a thread located on the newly inserted tube in the form of starter turns, since in this way a starter bobbin, together with the drive and space requirements necessary for this, becomes superfluous. To avoid auxiliary bobbins or tubes with attached starter turns under normal thread-joining conditions, thread-joining appropriately takes place, in this case, before the bobbin change by means of the thread resupplied from the full bobbin.

It is customary to drive the spooling device during the thread-joining operation not only for the resupply, but also for starting the thread draw-off. In order that, in connection with the process according to the invention, additional control elements or auxiliary units are not required for the immediate draw-off of the thread after resupply, it is appropriately envisaged that, after the resupply for thread-joining, the thread first be wound, together with the leader, onto the full bobbin or onto the newly inserted tube. The thread portion with the leader is then unwound again from the full bobbin or the newly inserted tube and guided away together with the thread supplied by the open-end spinning mechanism. Advantageously, so that each bobbin can be driven individually during this time, the bobbin can be driven, during thread-joining and bobbin change, independently of the drive effective during the normal spinning operation.

According to an advantageous feature of the invention, when a bobbin change is carried out, first the full bobbin is ejected from the spinning device. A new tube is subsequently inserted in the spinning device. The thread run of the newly joined and constantly guided-away thread is then prolonged to beyond the spooling device, whereupon the thread is deflected in the direction of the newly inserted tube so that the thread partially loops round the tube. Since the thread run is prolonged to beyond the spooling device after the full bobbin has been ejected and after the new tube has been inserted, the newly joined thread and the thread being guided away is located between the drive roller of the spooling device and the tube. By deflecting the thread in the direction of the tube, a partial looping of the tube is achieved, so that the latter, especially when it has a rough surface, carries the thread along with it during its rotation.

According to a preferred design of the subject of the invention, after the bobbin change has been carried out, the thread run of the newly joined and guided-away thread is prolonged, in relation to the direction of transport of the thread supplied by the open-end spinning mechanism, until the thread run crosses the path of a thread-catching device provided on the spooling device. In this way, prolongation of the thread run can take place after the bobbin change out of synchronism with the exchange of the full bobbin for a new tube.

The tube resting against the drive roller is driven so that in the region of the clamping line between the drive roller and the tube, its direction of movement coincides with the thread transport direction. A thread-catching device which is provided on the spooling device and which can catch the thread only in the region of the tube facing away from the clamping line therefore moves in a direction opposite to the thread transport direction so that the thread is slackened when received by the tube. Furthermore, since the thread is not traversed during the formation of the spare turns, the winding-on speed is also less than the speed of the thread supplied by the open-end spinning mechanism. To compensate for these thread lengths, advantageously during the start of winding-up, the surplus length of supplied thread which occurs is stored in the meantime and is used up again after the start of the bobbin build-up during building up of the normal bobbin windings. The operation of the start of winding-on also includes formation of the spare turns. Since the thread supplied after the thread portion with the leader has been severed can be longer than for the thread reserve, the surplus thread length not required for the transfer and formation of a thread reserve is advantageously severed and guided away in association with the transfer of the thread supplied by the open-end spinning mechanism to the newly inserted tube.

To create the precondition for ensuring that one and the same severing device can be used both for the severing operation to break off the supplied thread from the bobbin and for the severing operation to eliminate the attachment point in the newly joined thread and for the severing operation to sever the surplus thread length during transfer of the thread to the new tube, the thread portion containing the leader is preferably guided away as a loop.

For carrying out the process according to the invention, there are a thread-suction device, a thread feeder transferring the thread supplied to the thread-suction device to the newly inserted tube, and a thread-severing device assigned to the thread-suction device and/or to the thread feeder. The purpose of the thread-suction device is to guide away the thread portion with the leader, whereupon this is severed by means of the thread-severing device eliminating the leader obtained during thread-joining. The severed thread portion is then guided away by the thread-suction device. The thread feeder now moves into such a position that the thread can be transferred to the newly inserted tube, and the thread-severing device can be used to cut off the surplus thread length which is then guided away likewise by the thread-suction device.

According to an especially simple and, therefore, preferred design of the subject of the invention, the thread feeder is formed by the mouth of the thread-suction device which can be brought into a thread receiving position between the open-end spinning mechanism and the spooling device and into a thread transfer position for transferring the thread to the newly inserted tube.

To transfer the thread to the newly inserted tube, it is appropriately envisaged that the mouth of the thread-suction device can be brought out of the thread transfer position onto the side of the newly inserted tube facing away from the thread supply side and can subsequently be moved perpendicularly to the axis of the tube in such a way that the thread extending to the mouth of the thread-suction device partially loops round the tube. To improve the attachment of the thread to the tube, especially after the surplus thread length has been severed, the thread-suction device can be switched over to a compressed-air source, so that the thread end can be blown against the tube.

For the transfer of the thread to the tube, it can also be envisaged, however, that the mouth of the thread-suction device can be brought out of the thread-receiving position into such a thread transfer position that the thread run crosses the path of a thread-catching device provided on the spooling device.

So that it is possible to make do with a single thread-severing device for all the severing operations required for carrying out the process according to the invention, the thread-severing device is preferably located in the thread-suction device. Appropriately, in this case, the thread-severing device is designed as a closing member for the thread-suction device, since in this way neither a separate closing member nor a special control member is required for controlling the vacuum prevailing in the thread-suction device.

In order to make it possible to control the thread run for the thread to be received by the thread-suction device and/or transfer to the newly inserted tube and/or for the length of the thread reserve to be formed, there is preferably in the thread run between the open-end spinning mechanism and the spooling device a thread guide which is movable along the bobbin and to which a controllable thread release device is assigned. Advantageously, this thread guide movable parallel to the bobbin can be brought to the throw-off end of a centering spindle of stepped diameter which in an especially simple way forces the thread out of a random thread run into an established thread run.

Preferably, a thread store is located in the thread run in front of the bobbin for compensating the fluctuations in thread tension which arise during the start of the winding-on operation.

The subject of the invention requires no starter bobbins which have to be exchanged and is simple in its construction, in its function and in its control, and it makes it possible to produce bobbins without the leaders or other connections replacing these leaders, for example, knots, etc. which otherwise customarily pass unavoidably onto the newly inserted tube during the bobbin change. In this way, a yarn is produced with an essentially lower outlay in terms of work and time than hitherto, and this yarn does not contain the known irregularities which otherwise arise as a result of thread-joining coinciding with the start of spooling.

Further features and advantages emerge from the following description and the attached drawings in which only those parts of an open-end spinning unit necessary for an understanding of the invention are illustrated.

DESCRIPTION OF A PREFERRED EMBODIMENT

The invention will first be explained with reference to the design shown in FIG. 1. This illustration represents the essential parts of a spinning machine 1 working according to the open-end spinning process, which are required for joining and transferring a thread 35 to a newly inserted tube 38 after the leader has been eliminated. In practice, these parts are, as a rule, distributed over the spinning machine 1 and a maintenance device 2 movable along the spinning machine 1 but the invention can also be applied to a spinning machine 1 without a movable maintenance device 2.

Figure 1:
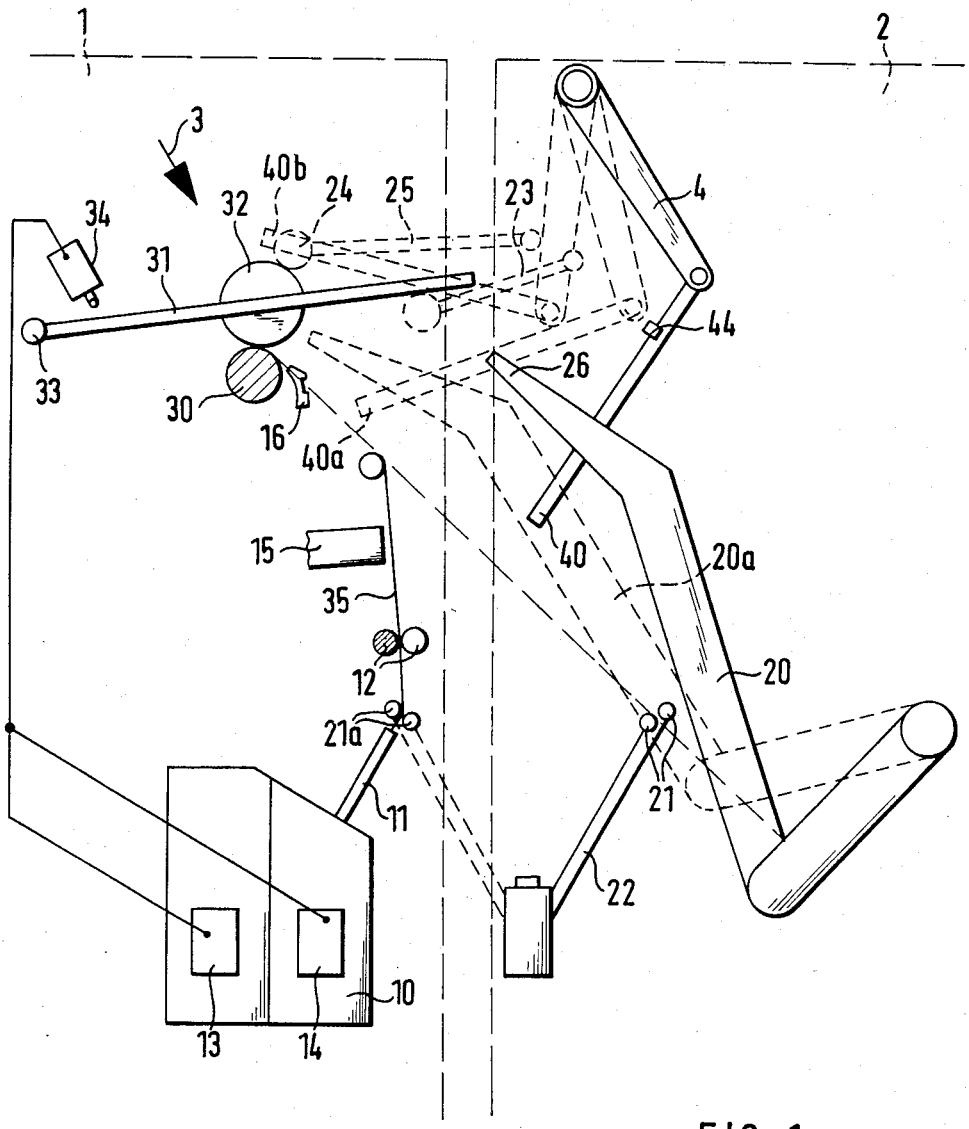
FIG. 1 shows a diagramatic representation of an open-end spinning unit designed according to the invention.

The spinning machine 1 has a plurality of spinning units of which FIG. 1 shows one spinning unit. The open-end spinning mechanism producing the thread 35 is located in a housing 10. The housing 10 has a thread outlet tube 11 through which the thread 35 leaves the housing 10 under the action of a pair of draw-off rollers 12.

Figure 2:
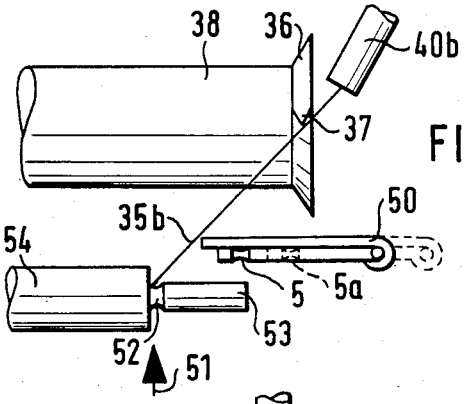
FIG. 2 shows, in a front view, a portion cut out from the spooling device in FIG. 1, during transfer of the thread to a newly inserted tube.

For winding the thread 35 on a bobbin 32, the spinning machine 1 has a spooling device 3 which possesses essentially a drive roller 30 for driving the bobbin 32 carried between two bobbin arms 31. The bobbin arms 31 are pivotable about an axle 33. Each of the two bobbin arms 31 of the spooling device 3 possesses, for receiving and centering the bobbin 32, a bobbin plate 36, and one of these carries a thread-catching device 37 (FIG. 2).

According to FIG. 1, there is in the spinning machine 1 a switch 34 which, when a specific pivoting position is reached, can be actuated by one of the bobbin arms 31, and which is connected controllably to a sliver supply device 13, by means of which a sliver is fed to the spinning mechanism via a sliver disentangling device (not shown) and to a cleaning device 14 for the spinning mechanism.

Furthermore, a pneumatic thread store 15 is located in the thread run between the spinning mechanism and the spooling device 3. A traversing thread guide 16 or another traversing device is assigned to the spooling device 3 in a conventional way.

The maintenance device 2 movable along the spinning machine 1 receives the thread-joining device which has essentially a pivotable suction tube 20, with a longitudinal slit (not shown) on its side facing the thread run, and a pair of auxiliary rollers 21 mounted on a pivoting arm 22. The pair of auxiliary rollers 21 can be moved by the pivoting arm 22 in such a way that it can receive the thread 35, after this has left the suction tube 20 and can feed it to the mouth of the thread outlet tube 11. Furthermore, this pair of auxiliary rollers 21 can be driven in two directions of rotation.

Also located in the maintenance device 2 is a pivoting lever 23 which can lift the bobbin 32 up from its drive roller 30. Also provided for the drive of the bobbin 32 is an auxiliary drive roller 24 which is carried by a pivotable lever 25 and which can be brought into contact with the bobbin 32 lifted off from the drive roller 30.

The maintenance device 2 also possesses a thread-suction device 4, the mouth 40 of which can be brought into a thread-receiving position **40*a* in which it is located in the region of the thread run between the spinning element and spooling device 3. Moreover, the mouth 40 of the thread-suction device 4 can be brought into a thread transfer position 40*b* in which the thread 35 running into the thread-suction device 4 crosses the path of the thread-catching device 37 (FIG. 2**).

Located in the thread-suction device 4 is a thread-severing device 41 which preferably has a severing element movable transversely to the passage cross-section and an opposing severing element provided in the wall of the thread-suction device 4.

When the bobbin 32 has reached its desired size during the spinning process, the switch 34 is closed and causes the sliver supply device 13 to be stopped. A thread break is produced as a result. The maintenance device 2 is then called to the particular spinning unit in a known way and retained there. From the maintenance device 2 or from the switch 34, the cleaning device 14 for the spinning mechanism is actuated via a control device (not shown), so that fiber remains etc. are removed from the spinning mechanism.

Subsequently, the thread 35 is joined in a way which is likewise known. According to FIG. 1, the bobbin 32 is lifted off from the driver roller 30 for this purpose by means of the pivoting lever 23. The suction tube 20 is then brought out of its position of rest shown into the position **20*a* in which the mouth 26 is located in the immediate vicinity of the full bobbin 32. The auxiliary drive roller 24 is brought into contact with the bobbin 32 as a result of pivoting lever 25 and is now driven in the unwinding direction. The mouth 26 of the suction tube 20 now receives the end of the thread 35 unwound from the bobbin. The thread 35 is sucked into the suction tube 20 according to the unwinding speed of the bobbin and, at the same time, emerges in the form of a filament from the longitudinal slit in the suction tube 20. The thread 35 thus assumes the position 35*a* in which it is located in the pivoting region of the pair of auxiliary rollers 21. The pair of auxiliary rollers 21 is then pivoted out of its position of rest into the position 21*a* in front of the mouth of the thread outlet tube 11. During this movement, the pair of auxiliary rollers 21 grasps the thread 35, severs it, in a way not shown, underneath the pair of auxiliary rollers 21 and then presents it to the thread outlet tube 11. As a result of an appropriate drive of the pair of auxiliary drive rollers 21 and the bobbin 32 and because of the vacuum prevailing in the spinning mechanism, the thread 35 passes onto the collecting surface of the rotor to be joined with fibers which are supplied again in a known way to the rotor. By reversing the direction of rotation of the pair of auxiliary rollers 21 and the bobbin 32, the thread 35 is then drawn off again from the thread outlet tube 11** of the rotor.

The mouth 40 of the thread-suction device 4 is now brought into its thread-receiving position in the immediate vicinity of the thread run. After a time which is sufficient to ensure that as a result of its tension the thread 35 has been fed to the clamping region of the pair of draw-off rollers 12, the pair of auxiliary rollers 21 is spread open and swung back from its position 21*a* into its position of rest. At the same time, the direction of rotation of the bobbin 32 is reversed once again by means of the auxiliary drive roller 24. Because of its decreasing tension, the thread 35 is thus sucked in the form of a loop into the thread-suction device 4 and guided away continuously, this loop being fed from the thread resupplied from the bobbin 32 and the thread supplied by the spinning mechanism.

When this loop has reached such a size that the attachment point wound previously onto the full bobbin 32 has passed the thread-severing device 41, the thread-severing device 41 is actuated and the severed loop is guided away. As a result, the full bobbin 32 is severed from the supplied thread 35. Subsequently, the full bobbin 32 is driven for a short time in the winding-on direction so as to pull the thread extending from the bobbin 32 to the thread-severing device 41 out from the thread-suction device 4 and wind it on the bobbin 32. As a result of the auxiliary drive roller 24 being lifted off, the full bobbin 32 is stopped and is now exchanged in a known way for a new tube 38 (FIG. 2). When this has been carried out, the tube 38 is lowered onto the drive roller 30 by releasing the bobbin arm 31 so that the tube 38 is driven in the winding-on direction. Moreover, the mouth 40 of the thread-suction device 4 is pivoted in two planes into its thread transfer position 40*b* which ensures that the thread 35 assumes the position 35*b* (FIG. 2) and crosses the path of the thread-catching device 37. The thread 35 is thus wound onto the tube 38. Furthermore, the length of the thread portion located in the thread-suction device 4 is now limited as a result of renewed actuation of the thread-severing device 41, so that the position of the thread-severing device 41 in the thread-suction device determines the length of the free thread end at the end of the tube. The thread extending from the spinning mechanism to the thread-catching device 37 travels further and further towards the middle of the tube as a result of the thread tension, until it is grasped by the traversing thread guide 16. During the time when the thread 35 travels thus from the thread-catching device 37 into the working range of the traversing thread guide 16, the thread forms several turns as a thread reserve.

As shown in FIG. 2, it is not necessary for the thread run to be prolonged until it extends to the other side of the tube 38 in relation to the thread transport direction. If the conditions of space so permit, the mouth 40 of the thread-suction device 4 can also be located next to the bobbin plate 36.

When the thread 35 is caught by the thread-catching device 37, the latter runs counter to the thread transport direction. Furthermore, the thread is not traversed on the tube 38 during formation of the spare turns. Consequently, the winding-on speed is, in this case, less than the thread supply speed. This period of time is relatively short so that at relatively low thread draw-off speeds, this temporary thread surplus can be accepted under certain circumstances. For higher thread draw-off speeds, however, it is advantageous if the surplus thread length, which has occurred during the start of winding-on, that is to say during the time from catching of the thread 35 until after completion of the spare turns, when the actual bobbin buildup begins, is temporarily stored for the meantime. The pneumatic thread store 15 mentioned previously is provided for this purpose.

Where a thread reserve of definite and controllable length is desired, this can be obtained by providing according to FIG. 2, in the thread run between the open-end spinning element and the spooling device 3 a thread guide 5 which is movable along the bobbin 32 (or the tube 38) and to which is assigned a controllable release device 50 by means of which the thread 35 can be ejected from the thread guide 5. The thread guide 5 is designed so that it can receive the thread 35 between the open-end spinning element and the mouth 40 of the thread-suction device 4 located in the thread-receiving position 40*a*. When the mouth 40 assumes its thread transfer position 40*b*, the thread run is thus fixed precisely. As a result of axial adjustment of the thread guide 5 relative to the tube 38, the thread guide 5 is brought out of its position shown, in which it catches the released thread 35, into a second position 5*a* in which it feeds the thread 35 to the region of the tube 38 reserved for the spare turns. By shifting the thread guide 5 in the direction of the tube center and by subsequently actuating the release device 50, the thread 35 is ejected from the thread guide 5 and thus released in the working range of the traversing thread guide 16 and is grasped by the traversing thread guide 16.

To make it easier for the thread to be received by the thread guide 5 so that the latter can be made small, a centering spindle 51 is positioned in the thread run between the spinning mechanism and the spooling device 3. The centering spindle 51 has a centering groove 52 and, adjoining this, two spiral grooves opening into the centering groove 52 from opposite sides for guiding the thread 35. The centering spindle 51 has assigned to it a reversible drive motor (not shown) and has, in relation to the centering groove 52, at its throw-off end 53 facing away from the drive motor a small diameter than on its side 54 facing the drive motor.

When the thread leaves the suction tube 20 through its slit, it passes onto the centering spindle 51 which supplies the thread 35 to its centering groove 52 as a result of rotation in one direction. After thread-joining has been completed, the centering spindle 51 is rotated in the opposite direction so that the thread 35 travels to the throw-off end 53 of the centering spindle 51 and is thorn off. Before this, however, the thread guide 5 has been moved to the throw-off end 53 of the centering spindle 51 and intercepts the thread 35.

Figure 3:
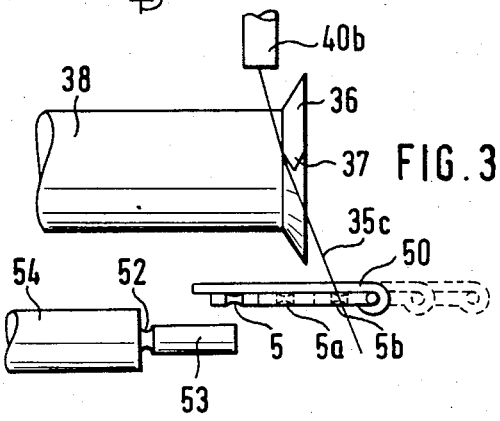
FIG. 3 shows, in a front view, a portion cut out from a spooling device, in which the transfer of the thread to the newly inserted tube takes place in a somewhat modified way in comparison with FIG. 2.

To prevent lateral movements of the thread-suction device 4, according to FIG. 3, the mouth 40 of the thread-suction device 4 must execute only a pivoting movement in a single plane perpendicular to the axis of the bobbin 32. So that the thread 35 can be fed to the thread-catching device 37, the thread guide 5 can, in this case, assume a further working position 5*b* in which the thread 35 assumes the position 35*c*. The thread reserve formed in this way is especially advantageous since, because of the relative arrangement of the mouth 40 of the thread-suction device 4 and the thread guide 5, the conventional conical form of the bobbin plate 36 ensures that the thread 35 is safely prevented from looping round the bobbin arm. Also, no free thread end arises, but a small loop which, during further processing, makes it possible in a simple way to draw off the thread reserve from the bobbin for connection to the next bobbin.

The plane of movement of the thread-suction device 4 is appropriately selected so that it is located in the region of the thread reserve. This ensures that, during winding-on, the thread end, which is drawn off from the thread-suction device 4 after the severing operation, arrives at the tube past the end face of the winding immediately before the bobbin 32 is ejected, and here one or two more turns form an addition to the thread reserve formed before the start of the bobbin build-up. This thread portion located on the end face is accessible especially easily for the purpose of connection to other bobbins, which is necessary during further processing and does not have to be sought for a long time.

In the above-described embodiment of the invention, the thread-severing device 41 is located in the thread-suction device 4. Since the severing operation takes place extremely quickly, even a temporary interruption of the vacuum prevailing in the thread-suction device 4 plays no part. Consequently, the movable severing element is preferably designed so that it assumes the function of a closing member for the thread-suction device 4, resulting in a simplification of the construction of the subject of the invention.

As required or in accordance with the type of transfer of the thread 35 to the bobbin 32 or to the tube 38, the thread end can or must be brought to a specific length. The thread-severing device 41 is necessary for this purpose, and in the case of short lengths, it is not located in the thread-suction device 4 but at its mouth 40. However, it is then no longer possible to guide the thread 35 away in the form of a loop through the thread-suction device 4 although this is especially advantageous in terms of the effectiveness of this thread-suction device 4.

Figure 6:
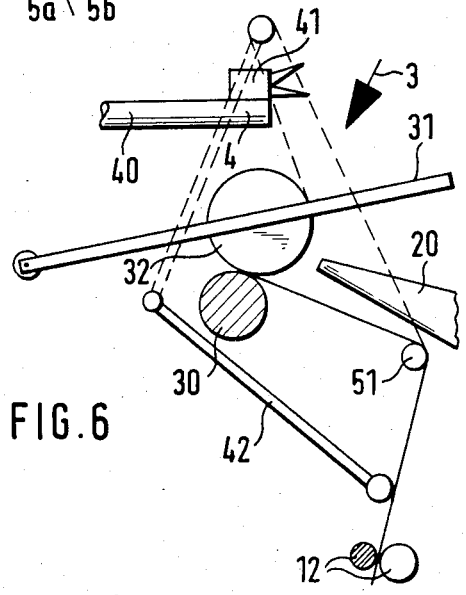
FIG. 6 shows a further modification of the apparatus according to the invention.

FIG. 6 shows an example of a thread-suction device 4 with a thread-severing device located at or near the mouth 40. In this exemplary embodiment, the thread-suction device 4 is stationary and located after the spooling device 3 in relation to the thread transport direction. Assigned to it is a pivotable mechanical thread feeder 42 which receives the thread 35 in the region of the thread run between the spinning mechanism and spooling device 3 and which supplies it to the mouth 40 of the stationary thread-suction device 4. By means of a suitable thread guide (not shown), for example, the thread guide 5, it is possible to ensure here that supplied thread 35 can come in contact with the tube 38 newly inserted in the meantime only after the leader has been guided away. Otherwise, the process corresponds to the processes previously described with reference to FIGS. 1 to 3.

If desired, a severing device 41 can be provided both on the thread feeder 42 and on or in the thread-suction device 4.

The subject of the invention can undergo numerous modifications both as regards the process and as regards the apparatus. Thus, the process in which a bobbin change takes place was described in the exemplary embodiment illustrated. But the process, according to the invention, can also be applied without a bobbin change being carried out, for example, when the spinning machine 1 has been stopped for a relatively long time because of maintenance or repair work and is then started up again or, for example, when the spinning mechanisms are exchanged for other spinning mechanisms of another shape and other dimensions. In the first case, no thread break needs to be produced, while in the second case, the spinning mechanism does not have to be cleaned so that thread-joining and the other operations described can be carried out immediately. Even in this way, the thread portion with the leader is eliminated before the bobbin build-up starts, the few turns wound on the bobbin 32 or on the tube 38 during thread-joining contributing nothing to the bobbin build-up because they are subsequently guided away by the thread-suction device 4.

With the example described, thread-joining is carried out by means of the thread 35 which was resupplied to the spinning mechanism from the full bobbin 32 before the bobbin change. It is, however, entirely possible to carry out the bobbin change first and equip the spinning unit with a tube 38 which carries a thread length sufficient for thread-joining in the form of starter turns. After thread-joining, the thread 35 is first wound onto the tube 38, as described in the example of the full bobbin 32, but is then unwound from this again completely by means of the auxiliary drive roller 24 and guided away through the thread-suction device 4. Winding onto the new tube 38 then takes place again, this tube thus serving as a starter tube and as a tube for receiving the bobbin.

During thread-joining, that is to say for the resupply for thread-joining, for the draw-off of the thread portion with the leader and for the further resupply to feed the thread portion with the leader to the thread-suction device 4, the tube 38 or the bobbin 32 can be driven, in principle, by the spinning machine 1 by driving the drive roller 30 temporarily via a clutch from the main machine drive by way of an intermediate gear. It is simpler, however, if the tube 38 or the bobbin 32 is driven from the maintenance device 2 via an auxiliary drive roller 24, since it is then also easier to synchronize with the other operations during thread-joining and the start of winding-on.

Instead of the turns first being wound onto the full bobbin 32 or the tube 38 after thread-joining, it is also possible to draw off the thread 35 from the spinning mechanism solely through the thread-suction device 4, in which case, if appropriate, the pair of auxiliary draw-off rollers 21 must remain effective until, after the above-described transfer of the thread 35 to the tube 38, the thread 35 is drawn into the clamping line of the pair of draw-off rollers 21 as a result of the delay in tensioning.

The device which initiates the bobbin change can likewise be designed differently. Instead of the switch 34 shown, which senses the position of the bobbin arm 31, there can be a light barrier which senses the bobbins, a timing element or a yarn-length counter, etc.

The particular design of the cleaning device 14 is also unimportant for the present invention. As long as the spinning mechanism does not require a specific construction because of its design (spinning rotor, electrostatic spinning element, etc.), this cleaning device 14 can be provided stationary for each spinning unit and can be actuated from the spinning unit or from the maintenance device 2. However, the cleaning device 14 can also be located in the maintenance device 2 and can be made to act on the spinning mechanism by opening the housing 10 or by introducing a cleaning element through a suitable opening in the housing 10, for example, the thread outlet tube 11. The same applies, in principle, to the thread-joining device which can be provided stationary on each spinning unit or in a maintenance device 2 for the entire spinning machine 1.

A further exemplary embodiment of the invention is described below, and in this, the thread-suction device 4 is coupled to a bobbin-change device. As shown, in FIG. 4, there is provided in the maintenance device 2 a pivoting link 6 of which the side facing the spinning machine 1 serves as an ejector for the full bobbin 32. On the side facing away from the spinning machine 1, the pivoting link 6 possesses a tube gripper 60 which has the job of collecting a tube 38 from a magazine or the like (not shown) and placing it between the bobbin arms of the spooling device 3. At its side edge, the pivoting link 6 carries the thread-suction device 4, a thread-severing device 41 being assigned to the mouth 40 of the latter.

Figure 4:
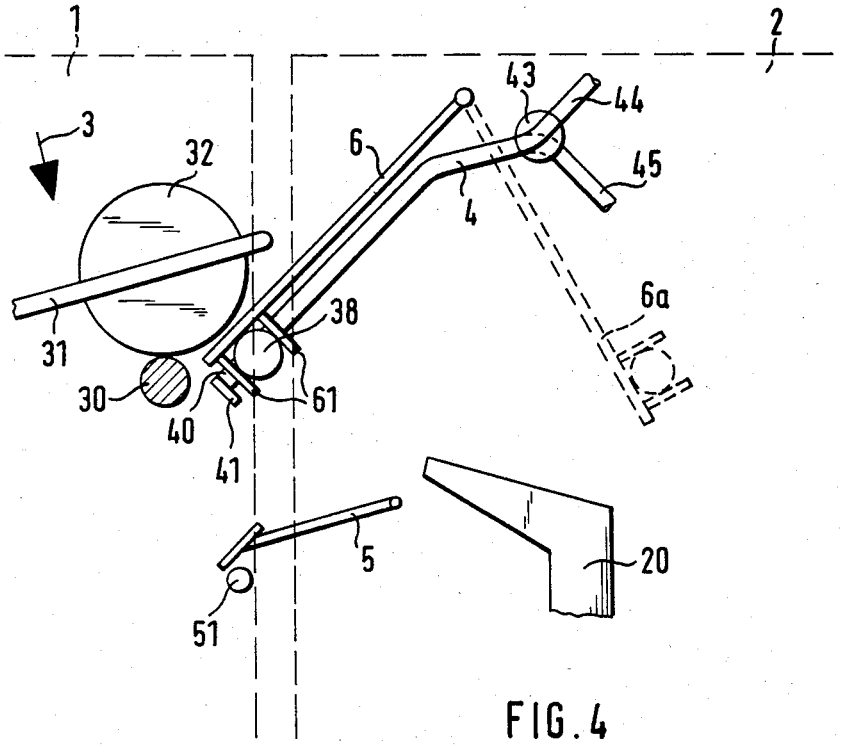
FIG. 4 shows a diagramatic representation of another embodiment of the subject of the invention.
Figure 5:
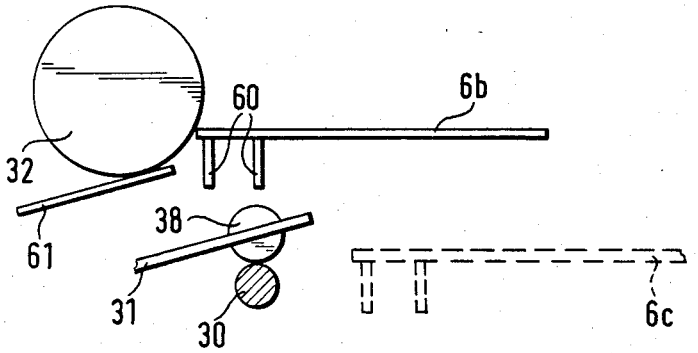
FIG. 5 shows part of the apparatus illustrated in FIG. 4 in another working phase.

When a bobbin change, associated with an operation to clean the spinning mechanism and with rejoining of the thread, is to be carried out, the pivoting link 6 is brought out of its position of rest *6a* into the thread-receiving position shown in FIG. 4. In this position, the thread 35 is fed to the mouth 40 of the thread-receiving device 4, possibly by means of a centering spindle 51 and a thread guide 5. In one of the ways described above, the thread portion with the leader is guided away by the thread-receiving device 4, and the thread 35 extending to the bobbin 32 is severed by actuating the thread-severing device 41. Thereupon, the pivoting link 6 is lifted further, and the tube grippers 60 release the tube 38 when the latter is located exactly between the bobbin plates 36 of the bobbin arms 31. As a result of the pivoting link 6 being lifted further into the position *6b*, the full bobbin 32 is conveyed onto a discharge ramp 61. During this time, the bobbin arms 31 are always still in their lifted position (compare with FIG. 1). In this way, the thread run is prolonged to beyond the spooling device 3. The thread 35 is guided away constantly through the thread-suction device 4 which always follows the movements of the pivoting link 6. The pivoting link 6 is then moved perpendicularly to the axis of the tube 38 and brought into the transfer position *6c*, so that the thread run is deflected in the direction of the newly inserted tube and the thread 35 extending to the mouth 40 of the thread-suction device 4 partially loops round the tube 38. As a result of suitable characteristics of the surface of the tube 38, after the subsequent lowering of the tube 38 onto the drive roller 30, the tube carries with it the thread 35 which is now severed by the thread-severing device 41 from the remaining thread 35 located in the thread-suction device 4. The pivoting link 6 then returns into its position of rest *6a*.

To improve the take-up of the thread 35 by the tube 38, according to FIG. 4, there is in the thread-suction device 4 a reversing valve 43 by means of which the thread-suction device 4 can be connected selectively to a vacuum line 44 or to a compressed-air line 45. To transfer the thread 35 to the tube 38, that is to say, when the pivoting link 6 assumes it transfer position *6c*, the reversing valve 43 is thus actuated so as to connect the thread-suction device 4 to a compressed-air source via the compressed-air line 45. Otherwise, apart from when it is in its position of rest *6a*, the thread-suction device 4 is always connected to the vacuum line 44.

Further changes to the subject of the invention by interchanging features or by replacing them with equivalents, as well as combinations of these, come within the scope of the present invention.

What is claimed is:

1. A process for exchanging a full bobbin for a empty tube in a spooling device on an open-end spinning mechanism, wherein on reaching the desired spool size the open-end spinning mechanism is stopped and its fiber collecting surface is cleaned, said process comprising the following steps:

cleaning said fiber collecting surface of the open-end spinning mechanism after a thread break;

returning the thread from said full bobbin to the open-end spinning mechanism after said cleaning of the spinning mechanism and effecting a thread-joining operation;

withdrawing the thread from said open-end spinning mechanism after said thread-joining and guiding the joined thread away together with the thread join by means of a suction device;

severing a thread section extending from the suction device to said full bobbin;

removing said full bobbin from said spooling device and exchanging an empty tube in its place;

transferring said thread delivered by the open-end spinning mechanism to said suction device to said empty tube; and severing said thread end extending into said suction device.

2. The process according to claim 1 including:

withdrawing said thread from said spinning mechanism after thread joining by means of said full bobbin on said spooling device; and unwinding said thread section together having the thread join from said full bobbin on said spooling device and guiding said thread section away together with the thread delivered from said open-end spinning mechanism by said suction device.

3. The process according to claim 1 including continuing the guiding away of said thread section delivered from said spinning mechanism thread by means of said suction device after exchanging said empty tube and full bobbin, and moving said suction device so that said thread section delivered by the open-end spinning mechanism crosses the path of a thread-catching device provided on said empty tube on said spooling device.

4. The process according to claim 1 including storing a surplus length of the thread which continues to be delivered by said open-end spinning mechanism during winding of thread onto said empty tube for a period of time and using said surplus length after the start of the thread buildup on said tube.

5. The process according to claim 1 wherein the thread section containing the thread join is guided away as a loop.

6. The process according to claim 1 including continuing the guiding away of said thread section delivered from said spinning mechanism by means of said suction device after exchanging said empty tube and full bobbin, and prolongating the path of said thread delivered by the open-end spinning device so that said thread section device crosses the path of a thread-catching device provided on said empty tube on said spooling device.

* * * * *